US008041264B2

(12) United States Patent
Suchy et al.

(10) Patent No.: US 8,041,264 B2
(45) **Date of Patent: *Oct. 18, 2011**

(54) MULTIPLE-CHANNELED LAYER PRINTING BY ELECTROGRAPHY

(75) Inventors: Donna P. Suchy, Rochester, NY (US); Diane M. Herrick, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 12 days.

This patent is subject to a terminal disclaimer.

(21) Appl. No.: 12/548,470

(22) Filed: Aug. 27, 2009

(65) Prior Publication Data

US 2009/0317107 A1 Dec. 24, 2009

Related U.S. Application Data

(63) Continuation of application No. 12/069,586, filed on Nov. 29, 2007, now Pat. No. 7,616,917.

(51) Int. Cl.
*G03G 15/01* (2006.01)

(52) U.S. Cl. ..... 399/223

(58) Field of Classification Search ..... 399/222–224, 399/381, 388, 390

See application file for complete search history.

(56) References Cited

U.S. PATENT DOCUMENTS

| | | | | |
|---|---|---|---|---|
| 6,086,825 | A | 7/2000 | Sundberg et al. | |
| 6,746,832 | B2 * | 6/2004 | Okazaki et al. | 430/363 |
| 6,896,360 | B2 | 5/2005 | Cox et al. | |
| 2008/0159786 | A1 | 7/2008 | Tombs et al. | |
| 2009/0154948 | A1 | 6/2009 | Cahill et al. | |

FOREIGN PATENT DOCUMENTS

| | | |
|---|---|---|
| EP | 0765763 | 4/1997 |
| WO | WO88/10193 | 12/1988 |
| WO | WO98/54004 | 12/1998 |
| WO | WO2008/082648 | 7/2008 |
| WO | WO2009/011773 | 1/2009 |

* cited by examiner

*Primary Examiner* — Hoan Tran
(74) *Attorney, Agent, or Firm* — Donna P. Suchy

(57) ABSTRACT

Electrographic printing of one or more multi-channeled layers having a particular pattern by electrographic techniques. Such electrographic printing includes the steps of forming a desired print image, electrographically, on a receiver member utilizing predetermined sized marking particles; and, where desired, forming one or more final multi-channeled layers utilizing marking particles of a predetermined size or size distribution.

22 Claims, 8 Drawing Sheets

MULTIPLE-CHANNELED LAYER PRINTING BY ELECTROGRAPHY

CROSS REFERENCE TO RELATED APPLICATIONS

This application is a continuation of prior U.S. patent application Ser. No. 12/069,586, filed on Nov. 29, 2007 now U.S. Pat. No. 7,616,917 which is hereby incorporated herein by reference in its entirety.

FIELD OF THE INVENTION

This invention relates in general to electrographic printing, and more particularly to printing of raised toner to form one or more multi-channeled layers by electrographic printing.

BACKGROUND OF THE INVENTION

One common method for printing images on a receiver member is referred to as electrography. In this method, an electrostatic image is formed on a dielectric member by uniformly charging the dielectric member and then discharging selected areas of the uniform charge to yield an image-wise electrostatic charge pattern. Such discharge is typically accomplished by exposing the uniformly charged dielectric member to actinic radiation provided by selectively activating particular light sources in an LED array or a laser device directed at the dielectric member. After the image-wise charge pattern is formed, the pigmented (or in some instances, non-pigmented) marking particles are given a charge, substantially opposite the charge pattern on the dielectric member and brought into the vicinity of the dielectric member so as to be attracted to the image-wise charge pattern to develop such pattern into a visible image.

Thereafter, a suitable receiver member (e.g., a cut sheet of plain bond paper) is brought into juxtaposition with the marking particle developed image-wise charge pattern on the dielectric member. A suitable electric field is applied to transfer the marking particles to the receiver member in the image-wise pattern to form the desired print image on the receiver member. The receiver member is then removed from its operative association with the dielectric member and the marking particle print image is permanently fixed to the receiver member typically using heat, and/or pressure and heat. Multiple layers or marking materials can be overlaid on one receiver, for example, layers of different color particles can be overlaid on one receiver member to form a multi-color print image on the receiver member after fixing or a variable pattern having variations due to material lay down.

In the earlier days of electrographic printing it was desirable to minimize channel formation during fusing. Under most circumstances, channels are considered an objectionable artifact in the print image. In order to improve image quality, and still produce channels a new method of printing has been formulated and is described below that forms one or more multi-channeled layers using electrographic techniques. There is a need to produced images with the ability to vary the image with minimal energy input. The use of layered printing, including possible raised images to create channels capable of allowing movement of a fluid, such as an ink or dielectric, to provide a printed article with, among other advantages, a variety of security features on a digitally printed document.

SUMMARY OF THE INVENTION

In view of the above, this invention is directed to electrographic printing wherein materials such as toner and/or laminates form one or more multi-channeled layers, with a particular pattern, which can be printed by printing, such as electrographic techniques. Such electrographic printing includes the steps of forming a desired pattern or image, electrographically, on a receiver member and incorporating channels that are embedded into the design so that they are in a virtually undetectable by the unaided human eye.

The multi layered channel printing apparatus and related method and print incorporates one or more static layers, such as one with red blue and white and one or more moveable layers that allow a fluid, such as a color yellow, to move through the micro channels via an opening and possibly including membranes and/or a micro pumps, such as in dielectrophoresis, to create fluid movement for small quantities of liquids that when overlapping a static layer can create a variable color or other physical characteristics. For example this method can be used to transport a yellow color from micro cells or chambers through channels to cover a red, blue, and white color and create a variety of colors. This could be used with a variety of fluids and could even combine transmissive and reflective color combinations.

The printing method for producing a variable color image upon a receiver include the steps of depositing a static layer of toner to form a predetermined base layer, depositing one or more toner nodes over the static layer, said toner nodes in a first state, such as one that is substantially undetectable and depositing a top layer of toner over said toner nodes, said top layer defining an expansion space between the static layer and the top layer so that during activation the one or more toner nodes can move into the expansion space to create a predetermined an alteration of the layers, as may be detected by the human eye.

The invention, and its objects and advantages, will become more apparent in the detailed description presented below.

BRIEF DESCRIPTION OF THE DRAWINGS

In the detailed description of the preferred embodiment of the invention presented below, reference is made to the accompanying drawings, in which.

7, having a predetermined multidimensional pattern formed in layers sufficient to form the final predetermined multi-channeled layers.

DETAILED DESCRIPTION OF THE INVENTION

Figure 1:
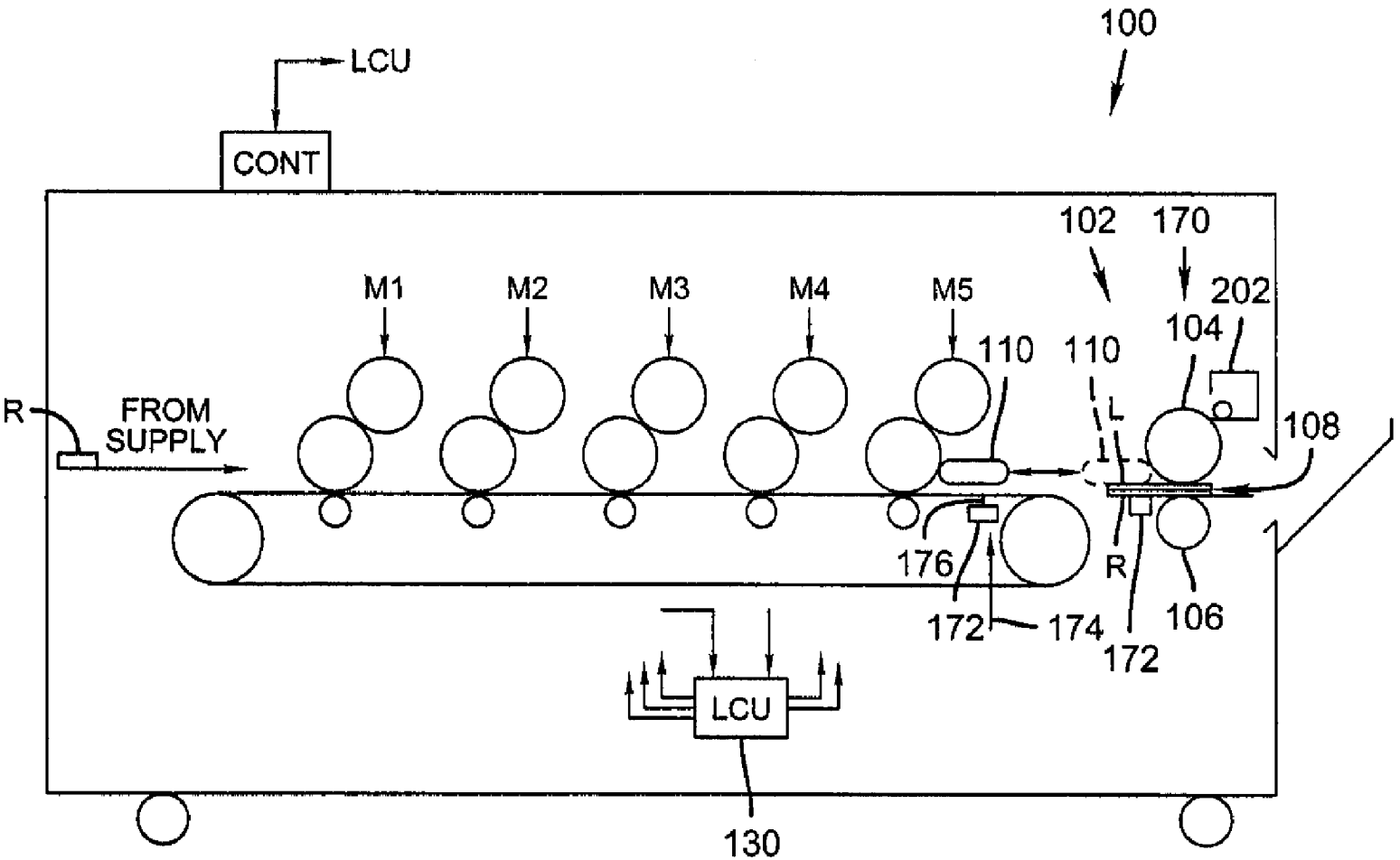
FIG. 1 is a schematic side elevational view, in cross section, of a typical electrographic reproduction apparatus suitable for use with this invention.
Figure 2:
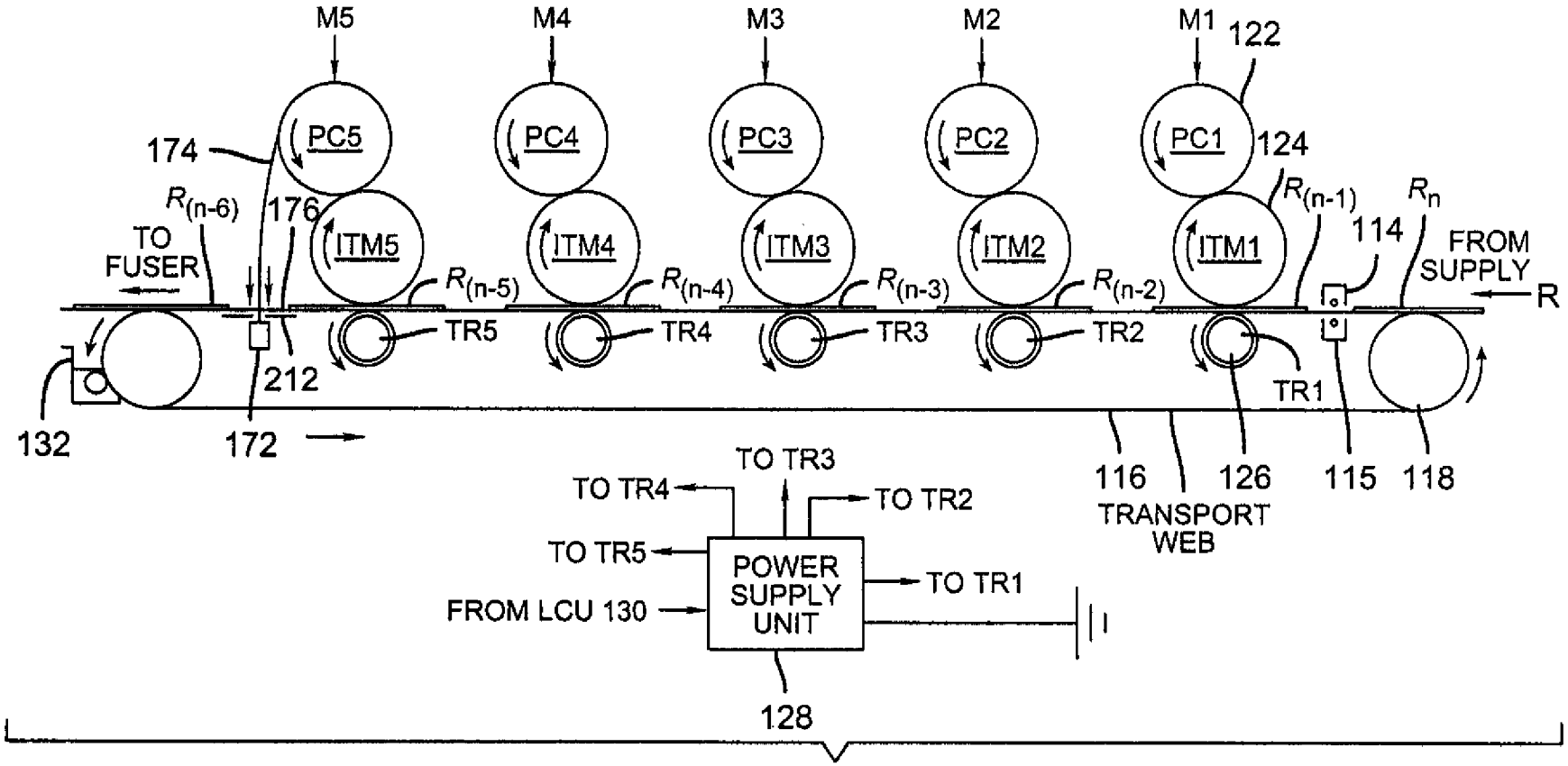
FIG. 2 is a schematic side elevational view, in cross section, of the reprographic image-producing portion of the electrographic reproduction apparatus of FIG. 1, on an enlarged scale.

Referring now to the accompanying drawings, FIGS. 1 and 2 are side elevational views schematically showing portions of a typical electrographic print engine or printer apparatus suitable for printing of multi-channel layered prints. One embodiment of the invention involves printing using an electrophotographic engine having five sets of single color image producing or printing stations or modules arranged in tandem and an optional finishing assembly. The invention contemplates that more or less than five stations may be combined to deposit material, such as toner on a single receiver member, or may include other typical electrographic writers, printer apparatus, or other finishing devices.

An electrographic printer apparatus 100 has a number of tandemly arranged electrostatographic image forming printing modules M1, M2, M3, M4, and M5 and a finishing assembly 102. Additional modules may be provided. Each of the printing modules generates a single-color toner image for transfer to a receiver member successively moved through the modules. The finishing assembly has a fuser roller 104 and an opposing pressure roller 106 that form a fusing nip 108 there between. The finishing assembly 118 can also include a laminate application device 110. A receiver member R, during a single pass through the five modules, can have transferred, in registration, up to five single-color toner images to form a pentachrome image. As used herein, the term pentachrome implies that in an image formed on a receiver member combinations of subsets of the five colors are combined to form other colors on the receiver member at various locations on the receiver member, and that all five colors participate to form process colors in at least some of the subsets wherein each of the five colors may be combined with one or more of the other colors at a particular location on the receiver member to form a color different than the specific color toners combined at that location.

In a particular embodiment, printing module M1 forms black (K) toner color separation images, M2 forms yellow (Y) toner color separation images, M3 forms magenta (M) toner color separation images, and M4 forms cyan (C) toner color separation images. Printing module M5 may form a red, blue, green or any other fifth color separation image. It is well known that the four primary colors cyan, magenta, yellow, and black may be combined in various combinations of subsets thereof to form a representative spectrum of colors and having a respective gamut or range dependent upon the materials used and process used for forming the colors. However, in the electrographic printer apparatus, a fifth color can be added to improve the color gamut. In addition to adding to the color gamut, the fifth color may also be used as a specialty color toner image, such as for making proprietary logos, a clear toner or a separate layer, such as a laminate L or film, for image protective purposes and/or a foil or filter for decorative or imaging purposes.

Receiver members ($R_n$-$R_{(n-6)}$, where n is the number of modules as shown in FIG. 2) are delivered from a paper supply unit (not shown) and transported through the printing modules M1-M5 in a direction indicated in FIG. 2 as R. The receiver members are adhered (e.g., preferably electrostatically via coupled corona tack-down chargers 114, 115) to an endless transport web 116 entrained and driven about rollers 118, 120. Each of the printing modules M1-M5 similarly includes a photoconductive imaging roller, an intermediate transfer member roller, and a transfer backup roller. Thus in printing module M1, a black color toner separation image can be created on the photoconductive imaging roller PC1 (122), transferred to intermediate transfer member roller ITM1 (124), and transferred again to a receiver member moving through a transfer station, which includes ITM1 forming a pressure nip with a transfer backup roller TR1 (126). Similarly, printing modules M2, M3, M4, and M5 include, respectively: PC2, ITM2, TR2; PC3, ITM3, TR3; PC4, ITM4, TR4; and PC5, ITM5, TR5. A receiver member, $R_n$, arriving from the supply, is shown passing over roller 118 for subsequent entry into the transfer station of the first printing module, M1, in which the preceding receiver member $R_{(n-1)}$ is shown. Similarly, receiver members $R_{(n-2)}$, $R_{(n-3)}$, $R_{(n-4)}$, and $R_{(n-5)}$ are shown moving respectively through the transfer stations of printing modules M2, M3, M4, and M5. An unfused image formed on receiver member $R_{(n-6)}$ is moving, as shown, towards one or more finishing assemblies 118 including a fuser, such as those of well known construction, and/or other finishing assemblies in parallel or in series that includes, preferably a lamination device 110 (shown in FIG. 1). Alternatively the lamination device 110 can be included in conjunction to one of the print modules, Mn, which in one embodiment is the fifth module M5.

A power supply unit 128 provides individual transfer currents to the transfer backup rollers TR1, TR2, TR3, TR4, and TR5 respectively. A logic and control unit 130 (FIG. 1) in response to signals from various sensors associated with the electrophotographic printer apparatus 100 provides timing and control signals to the respective components to provide control of the various components and process control parameters of the apparatus in accordance with well understood and known employments. A cleaning station 132 for transport web 116 is also typically provided to allow continued reuse thereof.

Figure 3:
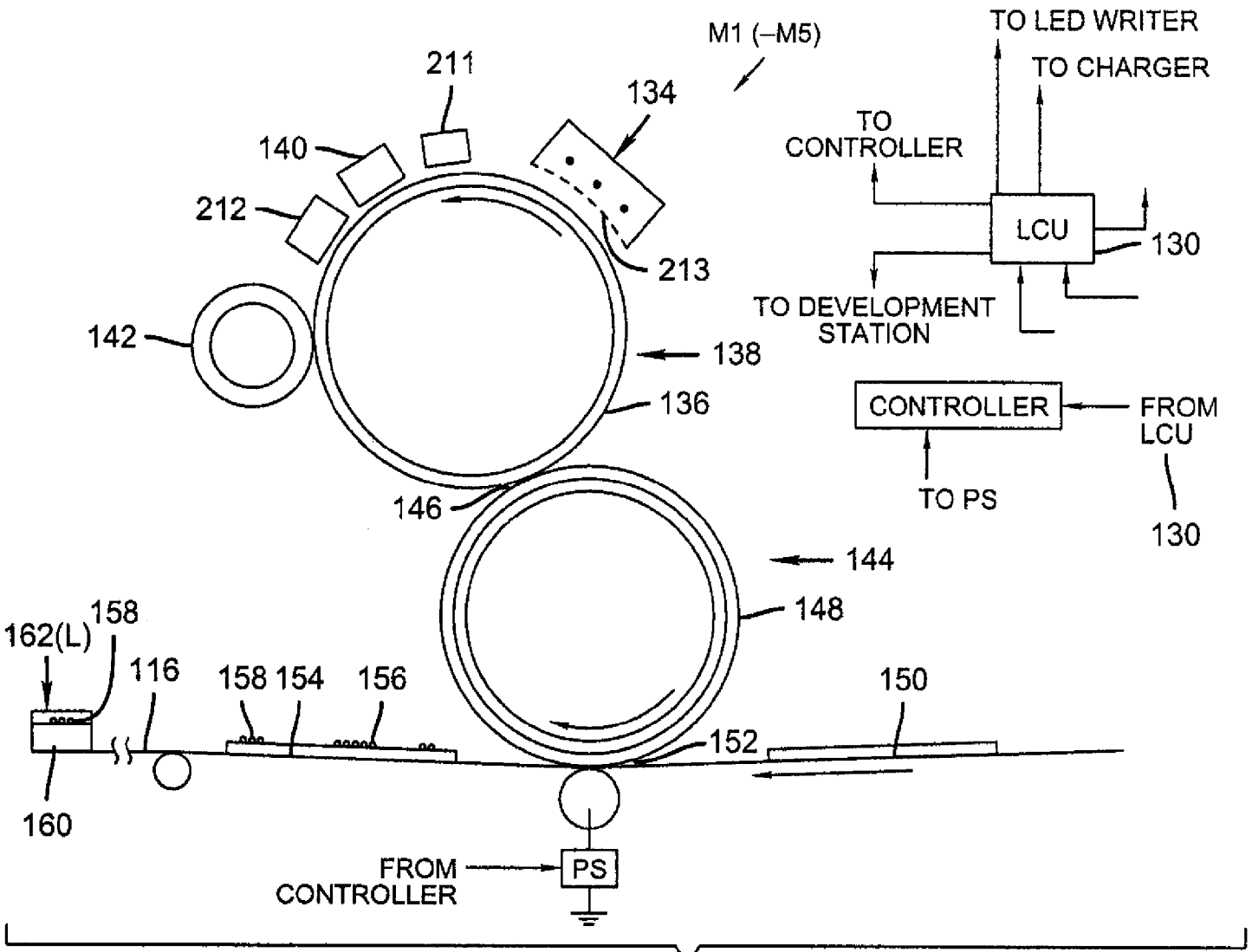
FIG. 3 is a schematic side elevational view, in cross section, of one printing module of the electrographic reproduction apparatus of FIG. 1, on an enlarged scale.

With reference to FIG. 3 wherein a representative printing module (e.g., M1 of M1-M5) is shown, each printing module of the electrographic printer apparatus 100 includes a plurality of electrographic imaging subsystems for producing one or more multilayered image or pattern. Included in each printing module is a primary charging subsystem 134 for uniformly electrostatically charging a surface 136 of a photoconductive imaging member (shown in the form of an imaging cylinder 138). An exposure subsystem 140 is provided for image-wise modulating the uniform electrostatic charge by exposing the photoconductive imaging member to form a latent electrostatic multi-layer (separation) image of the respective layers. A development station subsystem 142 serves for developing the image-wise exposed photoconductive imaging member. An intermediate transfer member 144 is provided for transferring the respective layer (separation) image from the photoconductive imaging member through a transfer nip 146 to the surface 148 of the intermediate transfer member 144 and from the intermediate transfer member 144 to a receiver member (receiver member 150 shown prior to entry into the transfer nip 152 and receiver member 154 shown subsequent to transfer of the multilayer (separation) image) which receives the respective (separation) images 156 in superposition to form a composite image 158 thereon. Receiver member 160 shown subsequent to the transfer of an additional layer 162 that can be, in one embodiment, a laminate L.

The logic and control unit (LCU) 130 shown in FIG. 3 includes a microprocessor incorporating suitable look-up tables and control software, which is executable by the LCU 130. The control software is preferably stored in memory associated with the LCU 130. Sensors associated with the fusing assembly provide appropriate signals to the LCU 130. In response to sensors S, the LCU 130 issues command and control signals that adjust the heat and/or pressure within fusing nip 108 and otherwise generally nominalizes and/or optimizes the operating parameters of finishing assembly 102 (see FIG. 1) for printing multi-channeled layers in an image 158 on a substrate for as print.

Subsequent to transfer of the respective (separation) multilayered images, overlaid in registration, one from each of the respective printing modules M1-M5, the receiver member is advanced to a finishing assembly 102 (shown in FIG. 1) including one or more fusers 170 to optionally fuse the multilayer toner image to the receiver member resulting in a receiver product, also referred to as a final multi-channeled layer print 175. The finishing assembly 118 may include a sensor 172, an energy source 174 and one or more laminators 110. This can be used in conjunction to a registration reference 176 as well as other references that are used during deposition of each layer of toner, which is laid down relative to one or more registration references, such as a registration pattern.

The laminator 110 may be placed such that the laminate 162 is laid down prior to fusing or after the initial fusing. In one embodiment the apparatus of the invention uses a clear, without any pigment, laminate in one or more layers. The clear laminate, in one embodiment, can have a thickness that is greater then the largest particle, such as a toner particle, and sufficient to prevent occlusion of the channel in the multi-channeled network. It is important that the laminate, also sometimes referred to as an adhesive film, can go onto of EP created channels without remelting the channels.

In one embodiment the material will have residual fusing oil on top, not all adhesive works well in an oiled environment. In that environment the laminate basically has oil absorption capability, so the lamination can be done uniformity on EP printed images. The idea here is 3-D channels (bottom and sides) can be created either via larger particle build up as a feature, or via stamping (with features) on thermal remeldable surface, such as coated surfaces. Alternately, as discussed above the surface texture can be applied early in the printing process. An example is stamping which is essentially a 2-D process. In all the processes it is necessary to close off the channels. Any process that allows the top layer to follow the features below will collapse the channels created and will not work. One workable means is to apply a laminate without too much pressure/heat applied in the finishing steps to created channels in the 10 s micron range as described below.

Figure 4:
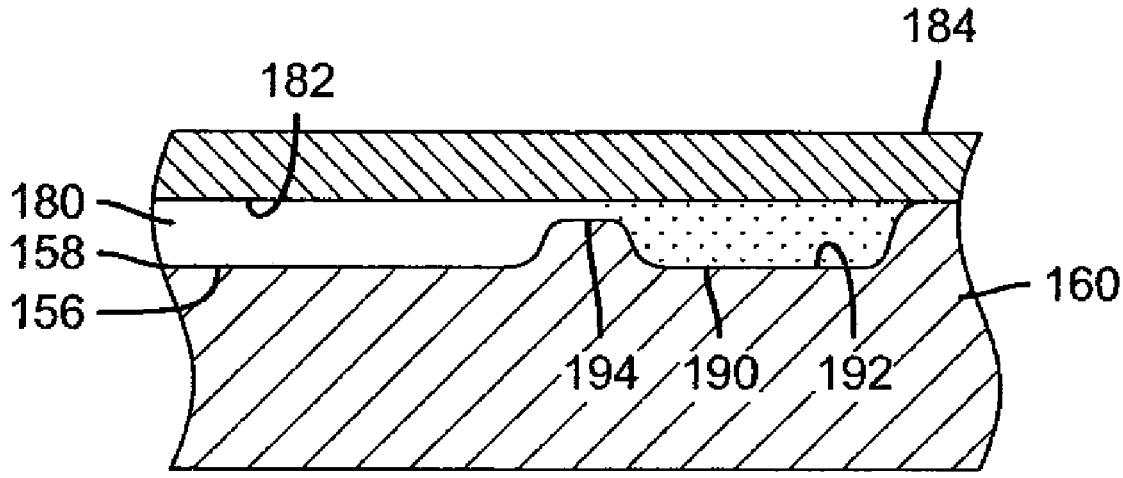
FIG. 4 is a schematic side elevational view, in cross section, of a print, produced by the invention.
Figure 5:
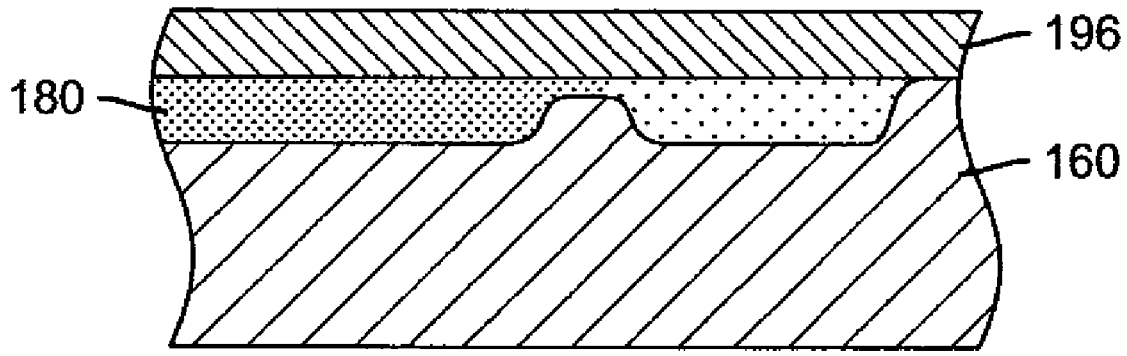
FIG. 5 is a schematic side elevational view, in cross section, of an activated print, having the predetermined multidimensional pattern formed in layers sufficient to form the final predetermined multi-channeled layers produced by the invention.

The use of laminates can also improve abrasion resistance, add various types of gloss and perform other advantages besides forming the top of a channeled network or array. It is necessary for the laminate, or an adhesive film used as a laminate, to have the structural integrity and thickness, as discussed above, to go onto electro photographic created channels without filling the channel when there are finishing actions, such as fusing, which is a remelting of the toner around the channels or the use of fusing oil on top. The laminate must work well in such an environment. One such laminate film is useful for this invention in an electro photographic digital printer and the laminate also has oil absorption capability, so the lamination can be applied uniformly to electro photographic printed images. One such laminate material is A laminate, such as Laminate GBC Layflat with a thickness of 37 um (micron) is useful for this application since the thickness is on the order of magnitude of the desired channel width of 10-50 um that are large enough to allow the particle, such as toner of less then 8 um to flow. By controlling the laminate thickness the channel is not occluded by distended laminate in that would block the channel A multiple-channeled layer 180 includes one or more aerially placed channels 182 of variable width but consistent thickness formed on the receiver 160, as shown in FIG. 4. There may be layers of material, such as toner, laid down between the receiver 160 and the multiple-channeled layer 180. The multiple-channeled layers 180, including the channels 182, are formed prior to the application of a laminate 184. The channel may also include a node 190 that is filled with a movable material 192, such as a fluid or pigment, as well as a narrowed section 194 formed as part of the channel 182. The multiple-channeled layer 180 is capped in one of a few ways including the application of the laminate 184 as described below or laid down as a top layer 196 as shown in FIG. 5, in one or more layers on top of the multiple-channeled layer 180.

The multiple-channeled layer 180 can be made using a larger particle or a chemically prepared toner (CDI) that is useful in building up as a feature as described in commonly assigned U.S. Publications 2008/0159786 and 2009/0154948 for Raised Print. The multiple-channeled layer 180 may also be formed as an embossed or varied surface via stamping (with features) on thermal remeldable surface, such as CDI coated surfaces. Two dimension embossing or stamping can create the desired structures needed before the laminate 184 is applied to the multiple-channeled layer 180. Alternatively the paper can have a surface that varies for other reasons that would contribute to the channels structure including a pre-treated paper, a paper of higher clay content or having other surface additives that in certain circumstances and conditions achievable in the printing cycle would change the surface profile to form a channel or channels having a pattern, such as a variable and/or periodic pattern.

If the top layer 196 is to be laid down to close off the multiple-channeled layer 180 it involves more then just coating the channel structure with toner such as chemically prepared dry ink (CDI) or an inkjet. The use of different treatable materials must be used so that the finishing processes, including fusing, will not follow the features below and collapse the channels created. If these do not exceed the melting conditions of the top layers needed to create channels, then the multiple-channeled layer 180 will be effectively intact in the final multiple-channeled layer print 160.

Figure 6:
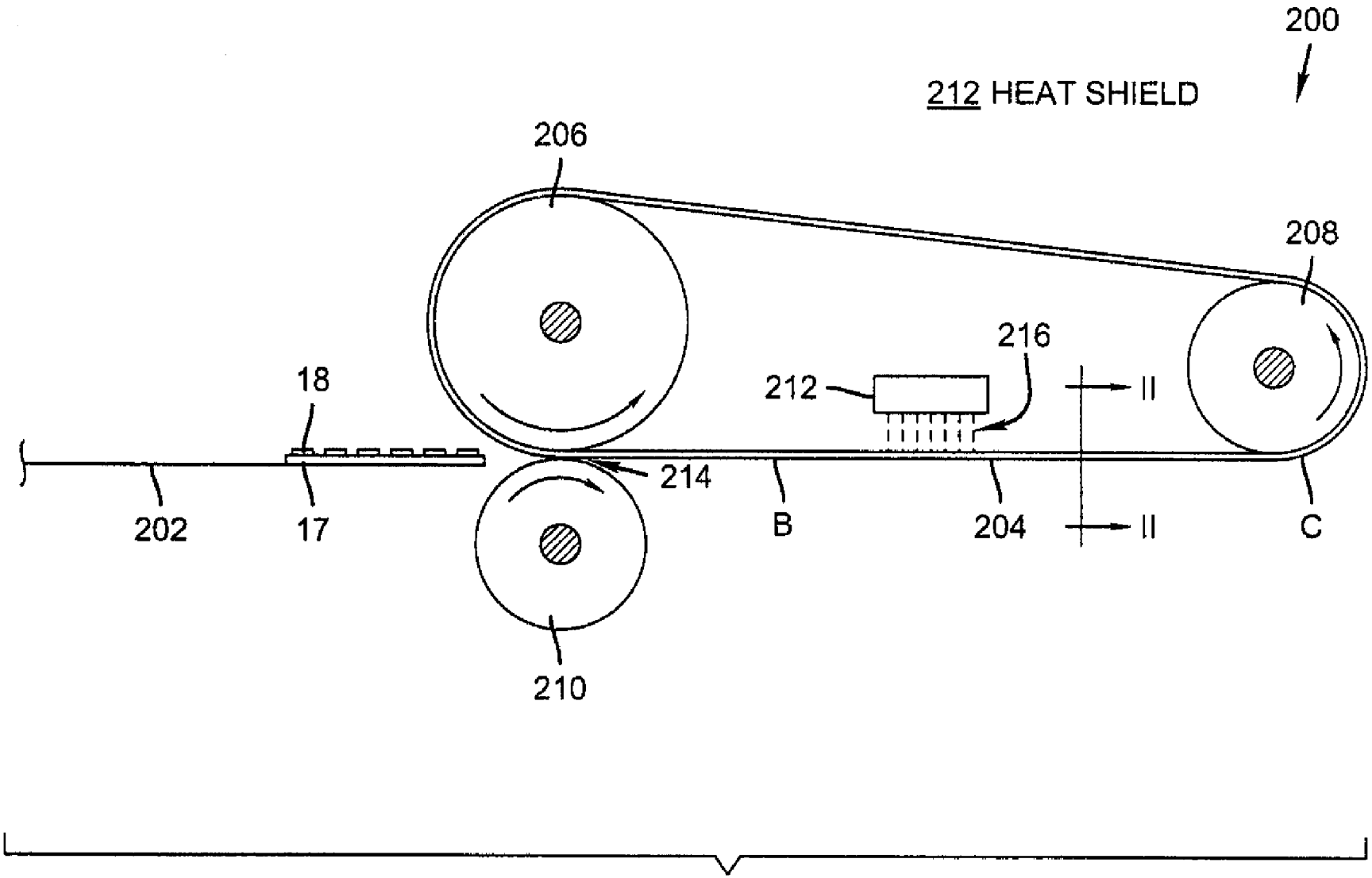
FIG. 6 is a schematic of a portion of the invention of FIG. 1.

One embodiment of the finishing assembly 118 that would allow the top layer to be applied during the fifth module is a type of finishing device 200 shown in FIG. 6. The multiple-channeled layer 180, along with one or more image layers, is transported along a path 202 to the finishing device. The finishing device includes a finishing or fusing belt 204, an optional heated glossing roller 206, a steering roller 208, and a pressure roller 210, as well as a heat shield 212. The fusing belt 204 is entrained about glossing roller 206 and steering roller 208. The fusing belt 204 includes a release surface of an organic/inorganic glass or polymer of low surface energy, which minimizes adherence of toner to the fusing belt 204. The release surface may be formed of a silsesquioxane, through a sol-gel process, as described for the toner fusing belt disclosed in U.S. Pat. No. 5,778,295, issued on Jul. 7, 1998, in the names of Jiann-Hsing Chen et al. Alternatively, the fusing belt release layer may be a poly (dimethylsiloxane) or a PDMS polymer of low surface energy, see in this regard the disclosure of U.S. Pat. No. 6,567,641, issued on May 20, 2003, in the names of Muhammed Aslam et al. Pressure roller 210 is opposed to, engages, and forms glossing nip 84 with heated glossing roller 206. Fusing belt 204 and the image bearing receiving member are cooled, such as, for example, by a flow of cooling air, upon exiting the glossing nip 214 in order to reduce offset of the image to the finishing belt 204. Alternately the finishing device could apply a laminate layer 184 and fuse that layer to the multiple-channeled layer 180.

The previously disclosed LCU 130 includes a microprocessor and suitable tables and control software which is executable by the LCU 130. The control software is preferably stored in memory associated with the LCU 130. Sensors associated with the fusing and glossing assemblies provide appropriate signals to the LCU 130 when the finishing device or laminator is integrated with the printing apparatus. In any event, the finishing device or laminator can have separate controls providing control over temperature of the glossing roller and the downstream cooling of the fusing belt and control of glossing nip pressure. In response to the sensors, the LCU 130 issues command and control signals that adjust the heat and/or pressure within fusing nip 108 so as to reduce image artifacts which are attributable to and/or are the result of release fluid disposed upon and/or impregnating a receiver member that is subsequently processed by/through finishing device or laminator 200, and otherwise generally nominalizes and/or optimizes the operating parameters of the finishing assembly 102 for receiver members that are not subsequently processed by/through the finishing device or laminator 200.

Figure 7:
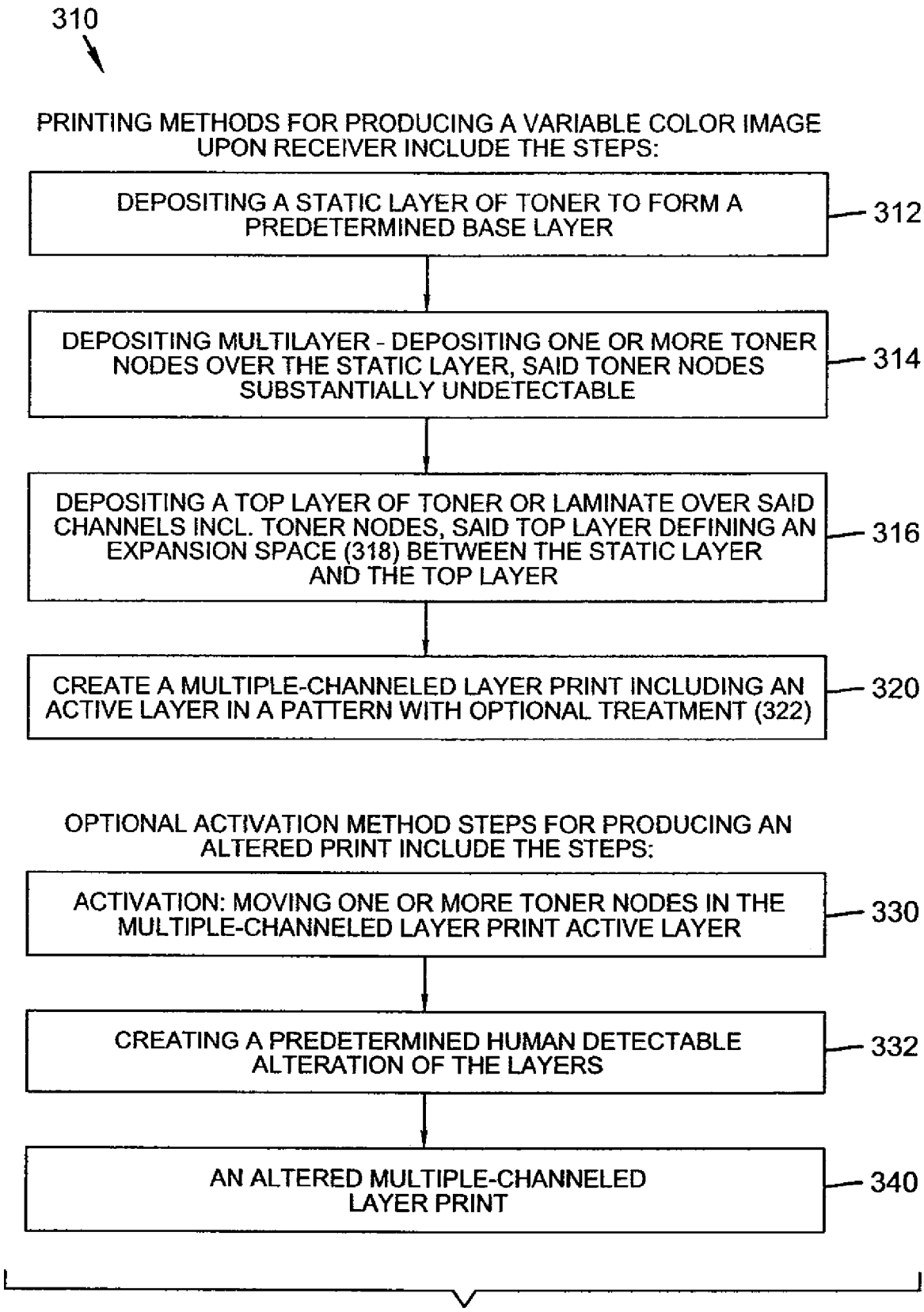
FIG. 7 is an embodiment of a method printing a multidimensional pattern upon a receiver.

In one embodiment, as shown in FIG. 7, the method for creating the electrographic multiple-channeled layer print 160, including the multi-channeled layers 180 upon a receiver R, includes the steps of depositing a first static layer of toner 310, relative to a registration reference 176, using marking and/or clear particles that to form one or more layers, depositing the multi-channeled layer 180 in a pattern P 312; which may be predetermined. This includes depositing one or more toner nodes 314, relative to the registration reference 176 and the previous layers. The nodes could be pre-filled with a movable material or filled at a later time and can be made to be substantially undetectable. A top layer of toner or a laminate 316 is deposited over the multi-channeled layer 180, including the toner nodes, so that the multi-channeled layer 180 defines an expansion space 318 between the static layer and the top layer so that during activation the one or more toner nodes can move into the expansion space to create a predetermined pattern such as a humanly detectable alteration of the print. When printing the printer registers the multi-channeled layer 180 relative to the previous layers to create a final multi-channeled pattern 320 with optional treatment 322. The final predetermined multi-channeled pattern can be treated and fixed, such as fusing with heat and/or pressure during fusing, to give the final multi-channeled layers. Optional activation steps can activate the multilayer print. The activation steps include moving 330 one or more filled toner node material(s) into the expansion space created by the multi-channeled layer 180 to create 332 a predetermined, such as an alteration of the layers and an altered multi-channeled layered print 340. This alteration could be humanly detectable or undetectable or based on other desired predetermined patterns.

Activation can be obtained through a variety of methods and devices, any of which could move the node through one or more channels by creating a pressure differential across the node. The pressure differential can be created, in one embodiment, by a pressure or heat source so that when the source contacts the node the toner in the node moves. This could be as simple as a person touching the surface of the printed receiver. Alternately a magnetic or electric energy source could be used.

Figure 8:
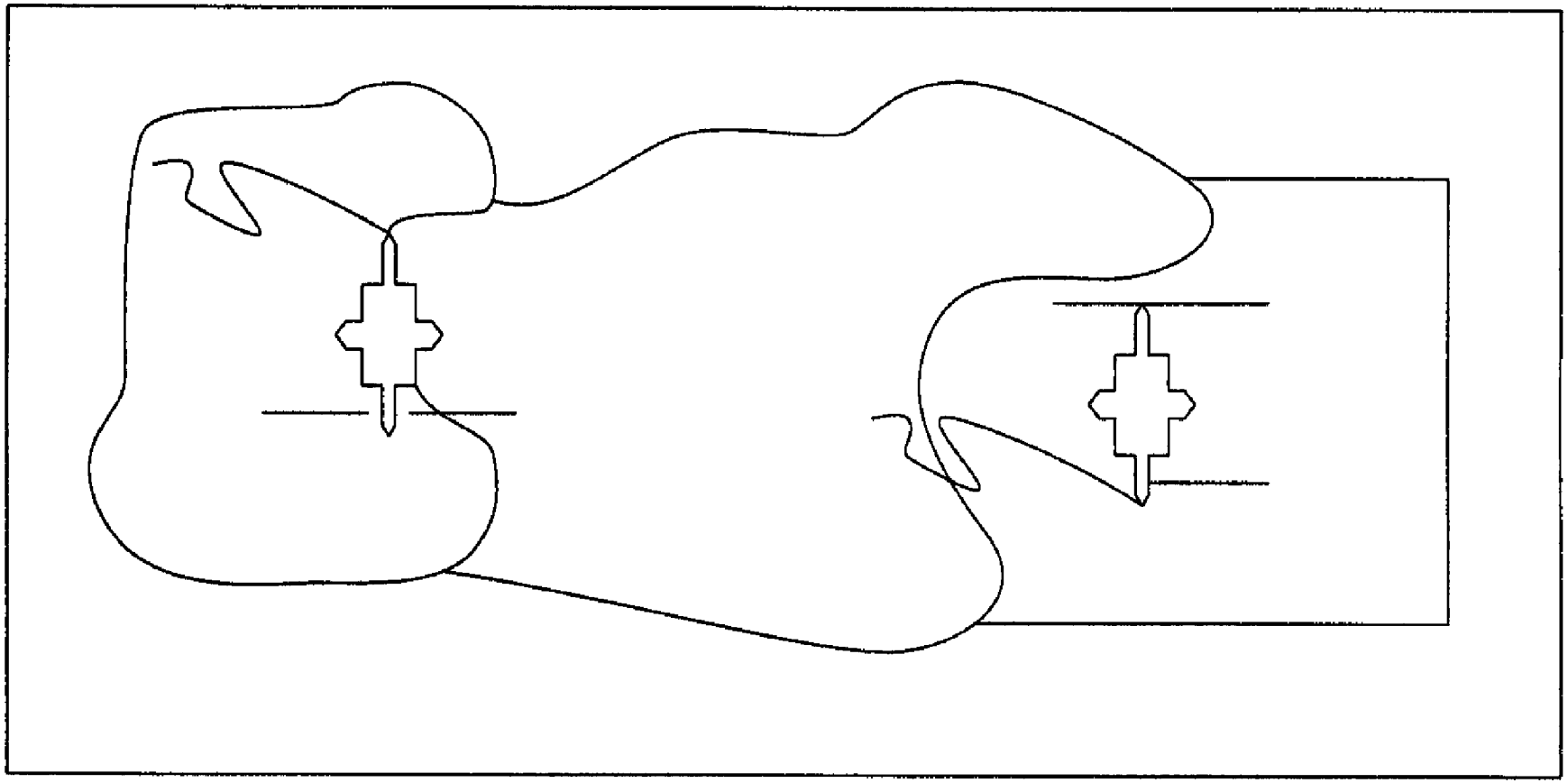
FIG. 8 is a schematic top view of another print, produced by the method of FIG. 7, having the predetermined multidimensional pattern formed in layers sufficient to form the final predetermined multi-channeled layers.
Figure 9:
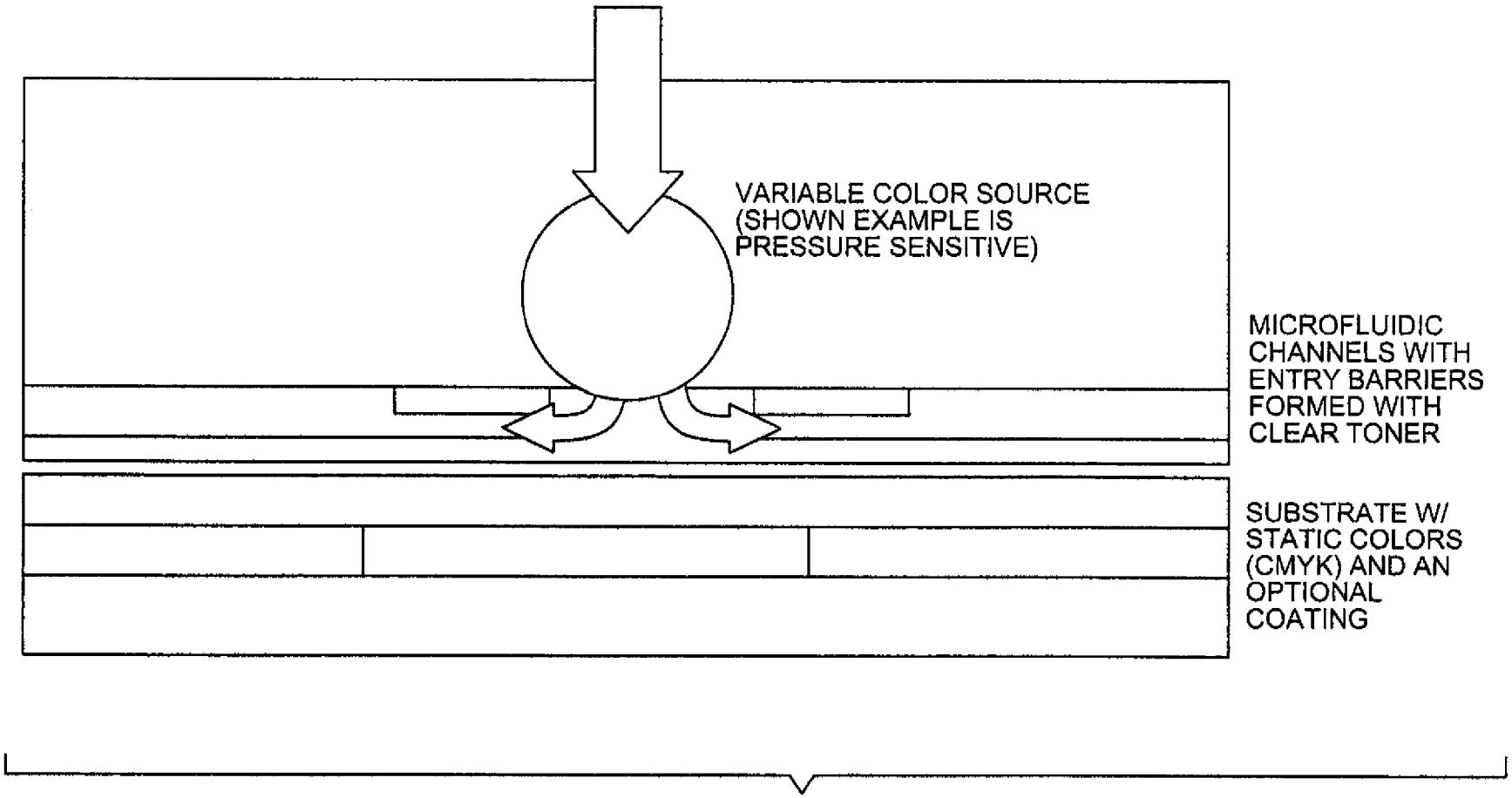
FIG. 9 is a schematic side elevational view, in cross section, of a print, produced by a modification of the method of FIG.

A few final multi-channeled layer prints 175 that are formed on the receiver member are shown in FIGS. 8 and 9. FIG. 8 shows a top view of a final multi-channeled print with the pattern P of the channels shown for ease of understanding. FIG. 9 shows final multi-channeled layers with the layers from the side.

In another embodiment the method for electrographic printing of multi-channeled layered print 175 upon the receiver uses both clear and pigmented material, for example toner and allows the printing of more than one multi-channeled layers over an image during the same or subsequent related passes. Specifically, it can be used to print two or more patterns on a receiver. The method includes additional similar steps to that described above, including a second or subsequent layer of toner deposited relative to the registration reference pattern to create a final multi-channeled pattern P. Steps 310-320 are repeated as required to form the predetermined multidimensional pattern P.

An inverse mask option can be used to help create a channel by using a image or pattern that has valleys in the surface and calculating a modified inverse mask as described in the commonly assigned U.S. Pat. No. 7,340,208 which is incorporated by reference. As described an application of clear toner can be deposited so that the clear toner forms an inverse mask when the inverse mask mode is selected for the fifth image-forming module M5 in accordance with the information for establishing or printing an inverse mask in clear toner in the referenced application. Image data for the clear toner inverse mask is generated in accordance with paper type and the pixel-by-pixel locations as to where to apply the clear toner. Information regarding the multicolor image is analyzed by a Raster Image Processor (RIP) associated with the LCU 130 to establish on a pixel-by-pixel basis as to where pigmented toner is located on the multicolor printed receiver member. Pixel locations having relatively large amounts of pigmented toner are designated as pixel locations to receive a corresponding lesser amount of clear toner so as to balance the overall height of pixel locations with combinations of pigmented toner and clear toner. Thus, pixel locations having relatively low amounts of pigmented toner are provided with correspondingly greater amounts of clear toner. In the printing of the clear toner as an inverse mask, the inverse mask image data may be processed either as a halftone or continuous tone image. In the case of processing this image as a halftone, a suitable screen angle may be provided for this image to reduce moire patterns.

In the present invention the inverse mask is calculated to leave a multi-channeled pattern on the receiver member with the clear toner overcoat, whether it be through an inverse mask printing or uniform overcoating, after the receiver is processed in the belt laminator to complete the fusing of the clear toner overcoat in the multicolor image to the receiver member in such a manner that the pigmented areas are fused but only some of the clear layer is fused causing the channels to remain. In one embodiment this is accomplished using two or more types of toner so that the clear toner fused at a second, higher temperature that is not affected by the fuser and thus leaves channels where the incomplete inverse mask is laid down. The fusing conditions and the conditions of the belt laminator are also adjusted for the type of receiver member.

The toner used to form the final multi-channeled layers can be styrenic (styrene butyl acrylate) type used in toner with a polyester toner binder. In that use typically the refractive index of the polymers used as toner resins have are 1.53 to almost 1.102. These are typical refractive index measurements of the polyester toner binder, as well as styrenic (styrene butyl acrylate) toner. Typically the polyesters are around 1.54 and the styrenic resins are 1.59. The conditions under which it was measured (by methods known to those skilled in the art) are at room temperature and about 590 nm. One skilled in the art would understand that other similar materials could also be used. These could include both thermoplastics such as the polyester types and the styrene acrylate types as well as PVC and polycarbonates, especially in high temperature applications such as projection assemblies. One example is an Eastman Chemical polyester-based resin sheet, Lenstar™, specifically designed for the lenticular market. Also thermosetting plastics could be used, such as the thermosetting polyester beads prepared in a PVA1 stabilized suspension polymerization system from a commercial unsaturated polyester resin at the Israel Institute of Technology.

The toner used to form the final predetermined pattern is affected by the size distribution so a closely controlled size and pattern is desirable. This can be achieved through the grinding and treating of particles to produce various resultants sizes. This is difficult to do for the smaller particular sizes and tighter size distributions since there are a number of fines produced that must be separated out. This results in either poor distributions and/or very expensive and poorly controlled processes. An alternative is to use a limited coalescence and/or evaporative limited coalescence techniques that can control the size through stabilizing particles, such as silicon. These particles are referred to as chemically prepared dry ink (CDI) below. Some of these limited coalescence techniques are described in patents pertaining to the preparation of electrostatic toner particles because such techniques typically result in the formation of toner particles having a substantially uniform size and uniform size distribution. Representative limited coalescence processes employed in toner preparation are described in U.S. Pat. Nos. 4,833,0118 and 4,965,131, these references are hereby incorporated by reference. In one example a pico high viscosity toner, of the type described above, could form the first and or second layers and the top layer could be a laminate or an 8 micron clear toner in the fifth station thus the highly viscous toner would not fuse at the same temperature as the other toner.

In the limited coalescence techniques described, the judicious selection of toner additives such as charge control agents and pigments permits control of the surface roughness of toner particles by taking advantage of the aqueous organic interphase present. It is important to take into account that any toner additive employed for this purpose that is highly surface active or hydrophilic in nature may also be present at the surface of the toner particles. Particulate and environmental factors that are important to successful results include the toner particle charge/mass ratios (it should not be too low), surface roughness, poor thermal transfer, poor electrostatic transfer, reduced pigment coverage, and environmental effects such as temperature, humidity, chemicals, radiation, and the like that affects the toner or paper. Because of their effects on the size distribution they should be controlled and kept to a normal operating range to control environmental sensitivity.

This toner also has a tensile modulus ($10^3$ psi) of 350-1020, normally 345, a flexural modulus ($10^3$ psi) of 300-500, normally 340, a hardness of M70-M72 (Rockwell), a thermal expansion of 68-70 $10^{-6}$/degree Celsius, a specific gravity of 1.2 and a slow, slight yellowing under exposure to light.

This toner also has a tensile modulus ($10^3$ psi) of 150-500, normally 345, a flexural modulus (103 psi) of 300-500, normally 340, a hardness of M70-M72 (Rockwell), a thermal expansion of 68-70 $10^{-6}$/degree Celsius, a specific gravity of 1.2 and a slow, slight yellowing under exposure to light according to J. H. DuBois and F. W. John, eds., in Plastics, $5^{th}$ edition, Van Norstrand and Reinhold, 1974 (page 522).

In this particular embodiment various attributes make the use of this toner a good toner to use. In any contact fusing the speed of fusing and resident times and related pressures applied are also important to achieve the particular final desired multi-channeled layers. Contact fusing may be necessary if faster turnarounds are needed. Various finishing methods would include both contact and non-contact including heat, pressure, and chemical as well as IR and UV.

The described toner normally has a melting range which can be between 50-300 degrees Celsius. Surface tension, roughness and viscosity should be such as to yield a better transfer. Surface profiles and roughness can be measured using the Federal 5000 "Surf Analyzer" and is measured in regular unites, such as microns. Toner particle size, as discussed above is also important since larger particles not only result in the desired heights and patterns but also results in a clearer multi-channeled layers since there is less air inclusions, normally, in a larger particle. Color density is measured under the standard CIE test by Gretag-Macbeth in calorimeter and is expressed in L*a*b* units as is well known. Toner viscosity is measured by a Mooney viscometer, a meter that measures viscosity, and the higher viscosities will keep an multi-channeled layer's pattern better and can result in greater height. The higher viscosity toner will also result in a retained form over a longer period of time.

Melting point is often not as important of a measure as the glass transition temperature (Tg), discussed above. This range is around 50-100 degrees Celsius, often around 118 degrees Celsius. Permanence of the color and/or clear under UV and IR exposure can be determined as a loss of clarity over time. The lower this loss, the better the result. Clarity, or low haze, is important for multi-channeled layers that are transmissive or reflective wherein clarity is an indicator and haze is a measure of higher percent of transmitted light.

Another embodiment for creating the final multi-channeled layer 180 includes using a patterned paper (like an embossed paper with a specific pattern) and/or pretreated paper. Alternately a patterned roller could be used on the print prior to application of the top layer, along with a non-contact fusing, using a high MW polymer or high viscosity polymer that would not fuse like regular toner and probably a particle size much smaller then out toner. Also possible metallic toner particles etc. Some papers, such as clay papers, actually will form a channel when heated at a higher temperature, such as during normal during fusing. The use of a clapper with clay content could be used along with a very smooth surface roller to create tiny blisters or micro spaces desired for this embodiment. The regulation of the heat and pressure would be used to control the size and shape of the multi-channels that would become the expansion spaces. Their size would be varied by the application of different amounts of heat and for different lengths of time and in conjunction with different pressures, preferably a low pressure. Finally the nodes could be prefilled, filled at a later date and the movable material could be an encapsulated material that would release the material at preset conditions. The movable material could include a visual or invisible tagent that was stable or that reacted when released to further become active and detectable by a variety of means including visual inspection, chemical detection and audible detection, as well as tactile detection.

In all of these approaches, a clear toner may be applied on top of a receiver or a pattern or a clear toner to form the final multi-channeled layers desired. It should be kept in mind that texture information corresponding to the clear toner image plane need not be binary. In other words, the quantity of clear toner called for, on a pixel by pixel basis, need not only assume either 100% coverage or 0% coverage; it may call for intermediate "gray level" quantities, as well.

The invention has been described in detail with particular reference to certain preferred embodiments thereof, but it will be understood that variations and modifications can be effected within the spirit and scope of the invention. This invention is inclusive of combinations of the embodiments described herein. References to a "particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular and/or plural in referring to the "method" or "methods" and the like are not limiting.

The invention claimed is:

1. A printing method for producing a variable pattern upon a receiver, said printing comprising the steps of:

a. depositing a static layer of toner to form a predetermined multi-channeled layer;

b. depositing a second layer of one or more nodes over the static layer, said nodes in a first state;

c. depositing a top layer of laminate over said nodes, said top layer and the multi-channeled layer defining an expansion space adjacent said nodes; and d. activating the one or more nodes into said expansion space to create a predetermined alteration of said layers.

2. Method according to claim 1 further comprising laying down a continuous static layer of toner to form one or more non-continuous expansion spaces.

3. Method according to claim 1 further comprising the depositing one or more nodes steps in registration with the depositing a static layer.

4. Method according to claim 1 further comprising laying down the first and second layer simultaneously.

5. Method according to claim 1 wherein said predetermined multi-channeled pattern P comprises one or more indicia.

6. Method according to claim 1 wherein said nodes comprise a taggent.

7. Method according to claim 1 wherein said nodes are encapsulated.

8. Method according to claim 1 wherein said expansion spaces further comprise a primary pattern.

9. Method according to claim 8 wherein said primary pattern comprises a paper property such as an embossed paper.

10. Method according to claim 8 wherein said primary pattern comprises a pattern by a patterned roller in conjunction with a toner comprising a high molecular weight polymer with high viscosity and a non-contact fuser.

11. A method for electrographic printing of one or more multi-channeled layers upon a receiver, said printing comprising the steps of:

a. depositing a first layer of toner, having predetermined sized particles;

b. depositing a second layer of toner, having predetermined sized particles, relative to the first layer, said second layer comprising one or more nodes; and c. repeating steps a and b as required to form a final multi-channeled layers.

12. Electrographic printing according to claim 11 further registering the first layer multi-channeled pattern P relative to the second layer(s) to form multi-channeled layers in relation to the pattern.

13. Electrographic printing according to claim 11 wherein the particular size distribution of particles for the first layer comprises a volume average diameter of 10-30 microns for the first layer and a volume average diameter of 6-8 microns for the overcoat second layer.

14. Electrographic printing according to claim 11 further comprising an intermediate layer between the first and second layer of toner.

15. Electrographic printing according to claim 11 wherein the final multi-channeled layers comprises a periodic pattern.

16. An apparatus for producing a variable pattern upon a receiver, the apparatus comprising:

a. an imaging member;

b. a development station for depositing two or more layers of toner by depositing a static layer of toner to form a predetermined multi-channeled layer and depositing a second layer of one or more nodes over the static layer, said nodes in a first state;

c. a lamination application device to apply a top layer of laminate over said nodes, said top layer and the multi-channeled layer defining an expansion space adjacent said nodes;

d. a controller for controlling the application of each layer to form the final receiver; and e. a treatment device for treating the final receiver to give said expansion space to create a predetermined pattern after an activating event to alter one of one or more nodes.

17. Apparatus according to claim 16 further comprising the depositing one or more nodes steps in registration with the depositing said static layer.

18. Apparatus according to claim 16 wherein said primary pattern comprises a pattern by a patterned roller in conjunction with a toner comprising a high molecular weight polymer with high viscosity and a non-contact fuser.

19. Apparatus according to claim 16 wherein the particular size distribution of particles for the first layer comprises a volume average diameter of 10-30 microns for the first layer and a volume average diameter of 6-8 microns for the second layer.

20. A variable pattern receiver, said receiver comprising:

a. a static layer of toner to form a predetermined multi-channeled layer;

b. a second layer of one or more nodes over the static layer, said nodes substantially in a first state;

c. a top layer of laminate over said nodes, said top layer and the multi-channeled layer defining an expansion space adjacent said nodes; and d. one or more activatable nodes in said expansion space to create a predetermined alteration of said layers not effected by a treatment device for treating the final receiver so that said expansion space to create a predetermined pattern after an activating event to alter one of one or more nodes is in tact after the first treatment device.

21. Receiver according to claim 20 wherein the toner comprises a first volume average diameter is as small as obtainable on that printer for the first layer and a volume average diameter larger then the first volume average diameter for the second layer pattern to give the final multi-channeled layers.

22. Receiver according to claim 20 wherein the particular size distribution of particles for the first layer comprises a volume average diameter of 10-30 microns for the first layer and a volume average diameter of 6-8 microns for the overcoat second layer.

* * * * *